US010280059B2

(12) United States Patent
Peirsman et al.

(10) Patent No.: US 10,280,059 B2
(45) Date of Patent: May 7, 2019

(54) COMPACT BEVERAGE DISPENSING UNIT

(71) Applicant: Anheuser-Busch InBev SA, Brussels (BE)

(72) Inventors: Daniel Peirsman, Brussels (BE); Sarah Van Hove, Brussels (BE); Johan Van Rompaey, Brussels (BE)

(73) Assignee: Anheuser-Busch InBev S.A., Brussels (BE)

( * ) Notice: Subject to any disclaimer, the term of this patent is extended or adjusted under 35 U.S.C. 154(b) by 0 days.

(21) Appl. No.: 14/398,428

(22) PCT Filed: Apr. 26, 2013

(86) PCT No.: PCT/EP2013/058696
§ 371 (c)(1),
(2) Date: Oct. 31, 2014

(87) PCT Pub. No.: WO2013/164259
PCT Pub. Date: Nov. 7, 2013

(65) Prior Publication Data

US 2015/0129618 A1 May 14, 2015

(30) Foreign Application Priority Data

May 2, 2012 (EP) ..... 12166358

(51) Int. Cl.
*B67D 1/00* (2006.01)
*B67D 1/14* (2006.01)
(Continued)

(52) U.S. Cl.
CPC ..... *B67D 1/0006* (2013.01); *B67D 1/04* (2013.01); *B67D 1/0412* (2013.01);
(Continued)

(58) Field of Classification Search
CPC .. B67D 1/0006; B67D 1/0412; B67D 1/0891; B67D 1/0894; B67D 1/1252;
(Continued)

(56) References Cited

U.S. PATENT DOCUMENTS 2,774,229 A * 12/1956 Thau ..... B67D 1/04 222/146.6
2,917,906 A * 12/1959 Woolley ..... F25D 3/06 222/146.6
(Continued)

FOREIGN PATENT DOCUMENTS

DE 20 2010 012 987 4/2011
EP 1 982 952 10/2008
(Continued)

*Primary Examiner* — Paul R Durand
*Assistant Examiner* — Andrew P Bainbridge
(74) *Attorney, Agent, or Firm* — Levy & Grandinetti

(57) ABSTRACT

A beverage dispensing device including a base having a support plate is disclosed. The device has a peripheral wall jutting out of the bottom of the support plate and extending along the perimeter of the support plate defining with the bottom surface an inner volume of the base. A source of pressurized gas is lodged in the inner volume of the base, with a device for connecting the source of pressurized gas to the interior of a beverage container outside the inner volume of the base. An elongated tapping column extends normal to the top surface of the base, having an elongated inner channel bringing in fluid communication the inner volume with a tapping valve head located at the opposite top, outlet end of the tapping column. The height of the peripheral wall allows the beverage dispensing device to dispense beverages when standing on the top surface of a counter.

10 Claims, 3 Drawing Sheets

(51) Int. Cl.

| | |
|---|---|
| ***B67D 1/04*** | (2006.01) |
| ***B67D 1/06*** | (2006.01) |
| ***B67D 1/08*** | (2006.01) |
| ***B67D 1/12*** | (2006.01) |

(52) U.S. Cl.
CPC ..... *B67D 1/0431* (2013.01); *B67D 1/0443* (2013.01); *B67D 1/06* (2013.01); *B67D 1/0857* (2013.01); *B67D 1/0888* (2013.01); *B67D 1/0891* (2013.01); *B67D 1/0894* (2013.01); *B67D 1/1252* (2013.01); *B67D 1/14* (2013.01); *B67D 1/1477* (2013.01); *B67D 2001/0092* (2013.01); *B67D 2001/0093* (2013.01)

(58) Field of Classification Search
CPC ..... B67D 1/1477; B67D 1/06; B67D 2001/0092–2001/0093; B67D 1/04; B67D 1/14; B67D 1/0431; B67D 1/0443; B67D 1/0857; B67D 1/0888; F23C 7/008; F04B 13/00; F04B 23/025; F04B 49/106
USPC .... 222/465.1–466, 530–534, 55, 146.6, 399, 222/608
See application file for complete search history.

(56) References Cited

U.S. PATENT DOCUMENTS

| | | | | | |
|---|---|---|---|---|---|
| 3,180,529 | A * | 4/1965 | Buffington | F25D 11/00 | 222/131 |
| 3,232,489 | A * | 2/1966 | Buffington | B67D 1/06 | 211/150 |
| 3,790,032 | A * | 2/1974 | George | B67D 1/06 | 222/146.1 |
| 4,164,853 | A * | 8/1979 | McDonough | F25D 3/06 | 222/108 |
| 4,265,374 | A * | 5/1981 | Sebalos | B65D 83/62 | 222/105 |
| 4,308,975 | A * | 1/1982 | Bowen | B67D 1/04 | 222/146.6 |
| 4,350,267 | A * | 9/1982 | Nelson | B67D 1/04 | 222/131 |
| 4,442,954 | A * | 4/1984 | Bergandy | F16K 7/045 | 137/488 |
| 4,491,247 | A * | 1/1985 | Nitchman | B65D 77/06 | 220/586 |
| 4,844,300 | A * | 7/1989 | Simons | B67D 1/06 | 222/108 |
| 5,080,261 | A * | 1/1992 | Green | B67D 1/0857 | 222/129.1 |
| 5,282,561 | A * | 2/1994 | Mihalich | B67D 1/0857 | 222/146.6 |
| 5,915,602 | A * | 6/1999 | Nelson | B67D 1/06 | 108/143 |
| 6,073,811 | A * | 6/2000 | Costea | B67D 1/0004 | 222/183 |
| 6,105,825 | A * | 8/2000 | Gomi | B67D 1/0832 | 222/146.6 |
| 6,832,487 | B1 * | 12/2004 | Baker | B67D 1/0868 | 222/146.6 |
| 7,086,566 | B2 * | 8/2006 | Goepfert | B67D 1/0007 | 222/135 |
| 7,757,908 | B1 * | 7/2010 | Buhl, Jr. | B67D 1/0406 | 141/231 |
| 7,810,679 | B2 * | 10/2010 | Wauters | B67D 1/0462 | 222/105 |
| 7,861,892 | B1 * | 1/2011 | White | B67D 1/06 | 222/108 |
| 8,453,882 | B2 * | 6/2013 | Johnson | B67D 1/0864 | 222/146.6 |
| 9,027,792 | B2 * | 5/2015 | Watts | B67D 1/0406 | 222/108 |
| 2003/0080142 | A1 * | 5/2003 | Meheen | G05D 16/2013 | 222/1 |
| 2004/0226967 | A1 * | 11/2004 | Van Der Klaauw | B67D 1/0412 | 222/146.6 |
| 2008/0017045 | A1 * | 1/2008 | McGuire | B01D 53/02 | 99/323 |
| 2008/0128456 | A1 * | 6/2008 | Grimwade | B67D 1/0412 | 222/399 |
| 2009/0044561 | A1 * | 2/2009 | Dalton | B67D 1/06 | 62/398 |
| 2009/0194564 | A1 * | 8/2009 | Tsubouchi | B67D 1/0406 | 222/23 |
| 2009/0283554 | A1 * | 11/2009 | Kelly | B05B 1/30 | 222/399 |
| 2010/0243676 | A1 * | 9/2010 | Bax | B08B 9/0552 | 222/148 |
| 2010/0282777 | A1 * | 11/2010 | Johnson | B67D 1/0864 | 222/146.6 |
| 2011/0108240 | A1 * | 5/2011 | Bax | B67D 1/06 | 165/104.19 |
| 2011/0114680 | A1 * | 5/2011 | Haskayne | B67D 1/04 | 222/526 |
| 2011/0139828 | A1 * | 6/2011 | Sommerfield | B67D 1/0406 | 222/399 |
| 2013/0056495 | A1 * | 3/2013 | Watts | B67D 1/0406 | 222/146.6 |
| 2015/0129618 | A1 * | 5/2015 | Peirsman | B67D 1/14 | 222/399 |

FOREIGN PATENT DOCUMENTS

| | | |
|---|---|---|
| EP | 2 146 832 | 10/2008 |
| EP | 2 148 770 | 10/2008 |
| EP | 2 148 771 | 10/2008 |
| EP | 2 152 494 | 10/2008 |
| WO | WO 02/28763 | 4/2002 |
| WO | WO 2004/050537 | 6/2004 |
| WO | WO 2009/115928 | 9/2009 |

* cited by examiner

COMPACT BEVERAGE DISPENSING UNIT

TECHNICAL FIELD OF THE INVENTION

The present invention concerns compact beverage dispensing units for dispensing through a dispensing tap a beverage, typically a carbonated beverage like beer, by pressurizing the interior of a container containing said beverage.

BACKGROUND OF THE INVENTION

Draught beer is often preferred by consumers to bottled or canned beer. Draught beer is generally served at the counter of a public house out of a refrigerated keg provided with a fluid connection to a source of pressurized gas for driving the dispensing of the beer through a dispensing line fluidly connecting the keg to a dispensing tap, comprising a valve for controlling the flow out of said tap. Full size dispensing units fixed to the counter of public houses are rather expensive and are generally financed by brewing companies. Furthermore, since they are encased in the counter, they cannot be moved. For example, in case of a temporary social event outside a public house, such as an outdoor event, wedding party, fair and the like, consumers would like to be offered draught beer for consumption. Besides the consumers' preference for draught beer, above a critical volume of consumption, serving bottled or canned beer would be too expensive and would generate too much waste. For these reasons, compact and mobile beverage dispensing units, offering the same quality of beer as a draught beer served at the counter of a public house, were developed and brought to the market. They are designed to accommodate a keg or container containing the beer, with a source of pressurized gas, such as a pressure gas bottle or a compressor. The containers used can be traditional metal kegs as used in public houses, possibly but not necessarily of smaller dimensions, or can include so called bag-in-containers as disclosed e.g., in EP 2146832, EP 2148770, EP 2148771, EP 21 52494 and the like.

For example, US 2004/0226967 proposes a roving dispensing unit comprising a cooling chamber suitable for accommodating and cooling a beer keg, a hollow column supported on said cooling chamber and a dispensing head comprising a tap valve. A source of pressurized gas, such as a compressor or a CO2 cartridge is provided for ensuring the necessary pressure for driving the beer flow out of the keg. A dispensing tube fluidly connects the keg to the tap valve. For reasons of hygiene, the dispensing tube is disposable and must be changed with each new keg. In one embodiment, the dispensing line is even permanently coupled to the keg to ensure that it will not be used a second time. Upon use, a new keg can be installed into the cooling chamber, and fluidly connected to a source of pressurized gas, generally located in the same chamber. The dispensing line is either permanently coupled to the keg or must be coupled thereto, before it is run through a channel defined in the hollow column until the dispensing tube outlet reaches the dispensing head of the column and is engaged into the tap valve mechanism. This "bottom-up" insertion system, wherein the dispensing tube is installed starting from the keg (located at the bottom) all the way up to the dispensing head (located at the top) requires that the dispensing line be provided with a shut-off valve to prevent the flow of beer out of the keg before the dispensing line is in place in the tap valve. It is clear that providing a shut-off valve to a disposable tube increases substantially the cost of use of the system. Furthermore, it can be quite cumbersome to drive up a flexible dispensing line through the hollow column which outlet to the cooling chamber is positioned at the back thereof as can easily be appreciated when looking e.g., at FIG. 2 of US 2004/0226967.

In order to facilitate the engagement of the dispensing tube into the tap valve, a rather critical operation which is difficult to control from the interior of the cooling chamber, WO 2009/115928 suggests to allow the opening of the dispensing head so that the dispensing tube outlet emerging from the opening at the top of the column can be handled from outside the cooling chamber and engaged more comfortably into the tap valve mechanism.

EP 1982952 extends the idea of allowing the opening of the column to the entire length thereof. This solution greatly simplifies the "bottom-up" installation of the dispensing tube since it needs only be passed from the interior to the exterior of the cooling chamber through a short channel crossing the top board of the cooling chamber before it can be handled from outside the cooling chamber, instead of having to drive it from the inside of the cooling chamber all the way up to the dispensing head.

Although the foregoing dispensing units are mobile, they still are rather cumbersome and quite expensive. The present invention proposes a compact, versatile, and economical dispensing unit that can fit almost anywhere and which is very simple to use and to connect to a dispensing keg.

SUMMARY OF THE INVENTION

The present invention is defined in the appended independent claims. Preferred embodiments are defined in the dependent claims. In particular, the present invention concerns a beverage dispensing unit comprising:

(A) A base portion, comprising:
- (a) A support plate comprising a top surface and a bottom surface and an opening connecting said top and bottom surfaces,
- (b) A peripheral wall jutting out of the bottom surface of the support plate and extending along at least a portion of the perimeter of said support plate and thus defining with said bottom surface an inner volume of the base portion, the free edge of the peripheral wall being suitable for stably supporting the support plate at a distance from a planar surface said peripheral wall rests upon, said distance corresponding to the height of the peripheral wall;
- (c) A source of pressurized gas lodged in the inner volume of the base portion, and connecting means suitable for fluidly connecting said source of pressurized gas to the interior of a beverage container located outside the inner volume of the base portion; and (B) An elongated tapping column extending substantially normal to the top surface of the base portion, an inlet end thereof being fixed to said top surface and comprising an elongated inner channel (2) bringing in fluid communication via said opening, the interior of the compartment with a tapping valve head located at the opposite top, outlet end of the elongated tapping column, said channel and tapping valve head being suitable for receiving and for controlling the flow of liquid through a dispensing line connected to the interior of said beverage container, Characterized in that, the height of the peripheral wall is such that the beverage dispensing unit is suitable for dispensing beverages when standing on the top surface of a counter or a worktop as found in traditional pubs and restaurants.

In practice, the peripheral wall can have a height comprised between 50 and 300 mm, preferably between 70 and 200 mm, more preferably between 100 and 150 mm. Such compact dispensing unit is extremely versatile and can be positioned in almost any flat worktop and moved away to another place very easily/

The source of pressurized gas can be a gas compressor, such as an air compressor, a pressure cartridge filled with pressurized gas, a solid substrate with gas molecules adsorbed on the surface thereof, or any combination thereof. In a preferred embodiment, the source of pressurized gas is either a pressure cartridge filled with pressurized gas or a solid substrate with gas molecules adsorbed on the surface thereof. Said source of pressurized gas can be connected to a gas compressor located either within or out of the inner volume of the base portion and suitable for refilling the source of pressurized gas when the pressure of the compressed gas stored therein becomes insufficient. In a most preferred embodiment the source of pressurized gas is provided with a pressure gauge suitable for measuring the pressure of the gas stored therein and with a CPU for activating the gas compressor as soon as the pressure indicated by the pressure gauge falls below a given value. In case a feature of the dispensing unit must be powered, such as for example a compressor or a display screen, a source of power such as a battery or an AC/DC transformer with connecting means to an AC supply net can be lodged in the inner volume of the base portion.

In a preferred embodiment, the dispensing unit comprises a CPU programmed for calculating the volume of liquid dispensed in a given time by computing at least the pressure inside the container and the opening time of the valve, wherein the pressure source (7) is such that the pressure inside the container is substantially constant during the dispensing lifetime of the container.

The valve element is preferably a pinch-valve comprising first and second jaws suitable for receiving in pinching relationship a flexible portion of the outlet end of a dispensing line and for controlling the flow of liquid therethrough by varying the distance between the first and second jaws from a first, closed position, d0, wherein the flexible portion of the dispensing line is squeezed and no liquid can flow, to a second, open position, d1, wherein the dispensing line is not squeezed or not squeezed completely and liquid can flow through the line.

When using the dispensing unit for the first time, or when using a new keg, a new dispensing tube should be used and loaded in the unit to bring the liquid content of the new keg in fluid communication with the tapping valve head. It is preferred that the dispensing column is such that the dispensing tube can be introduced in a top-down sequence. In other words, it is preferred that the inlet end of a dispensing tube including the connecting means can be introduced from the tapping column top end, preferably through the tapping valve head held in open position, all the way down to the inner volume of the base portion whence it can be connected to a new keg stored outside the inner volume of the base portion. If a pinch valve is used the column may advantageously comprise means for opening a portion of the channel comprising the pinch valve such that the first and second jaws can be separated from one another by a distance substantially larger than the one corresponding to the open position, d1. The portion of the channel which can be opened preferably comprises at least 60% of the total length of the channel, preferably at least 80%, more preferably at least 90%. In yet a preferred embodiment, the tapping valve head comprises a hinge assembly allowing the first and second jaws to be separated by a distance larger than the one corresponding to the open position, d1, and can preferably be separated from the rest of the column.

The present invention also concerns a beverage dispensing assembly comprising:

(A) A beverage dispensing unit as discussed supra, standing on the top surface of a counter or worktop of the type found in traditional pubs and restaurants;

(B) A beverage container containing a beverage to be dispensed, and being separate from the beverage dispensing unit, (C) A first, dispensing line extending from an inlet end connected to the container and in fluid communication with the beverage contained therein, through the channel of the tapping column, to an outlet end engaged in the valve element, and (D) A second, pressure line extending from an inlet end connected to the source of pressurized gas to an outlet end connected to the beverage container, in fluid communication with the interior thereof.

For drinks having to be served cool, the beverage container is preferably placed in a cooled compartment comprising openings for the passage of the dispensing line and pressure line from the inside to the outside thereof, said cooling compartment being preferably located under or adjacent the counter or worktop supporting the dispensing unit.

If the the valve is a pinch valve, a portion of the outlet end of the dispensing line to be engaged in said pinch-valve should be flexible. In an alternative embodiment, the outlet end of the dispensing line comprises a valve co-element suitable, when engaged therein, for collaborating with the valve head to control the flow of liquid through the dispensing line.

The dispensing assembly of the present invention is particularly suitable for dispensing a beverage contained in said container, preferably beer and carbonated malt based beverages, such as non alcoholic beer, or cider.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 1C:
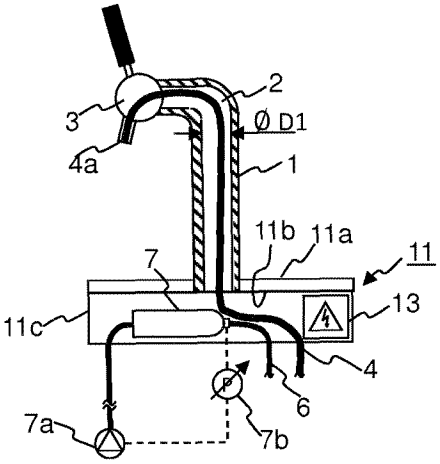
FIG. 1: shows three embodiments of a compact dispensing unit according to the present invention.
Figure 1B:
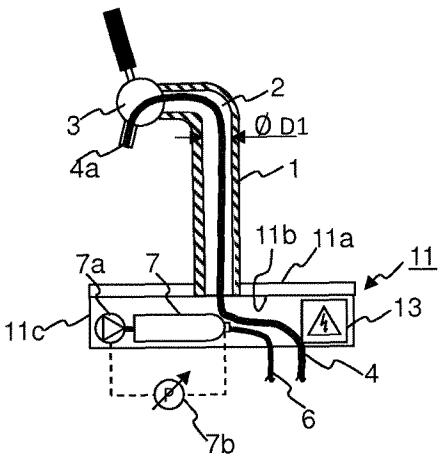
Figure 1A:
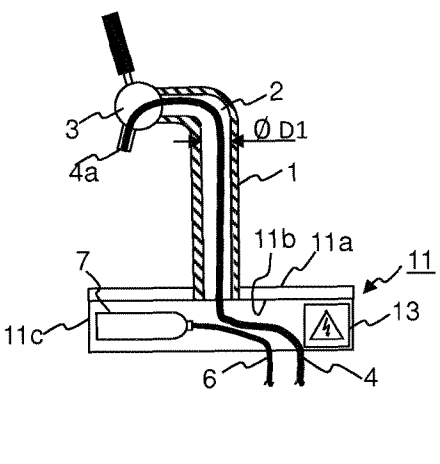
Figure 2:
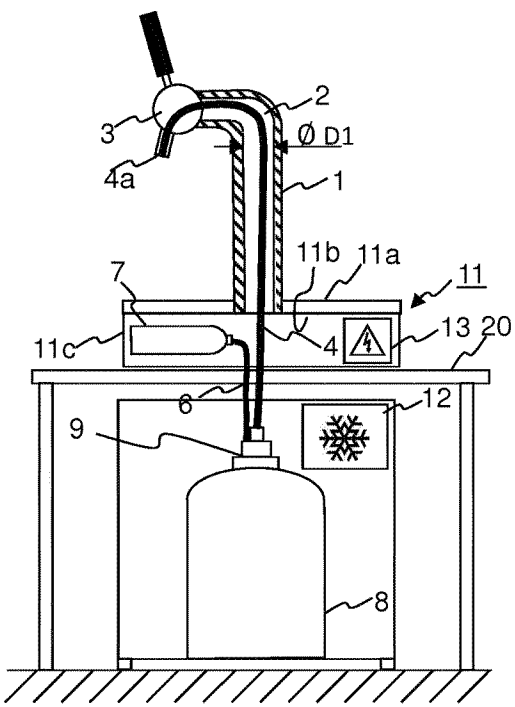
FIG. 2: shows one embodiment of a dispensing assembly comprising the dispensing unit of FIG. 1*a*.
Figure 3D:
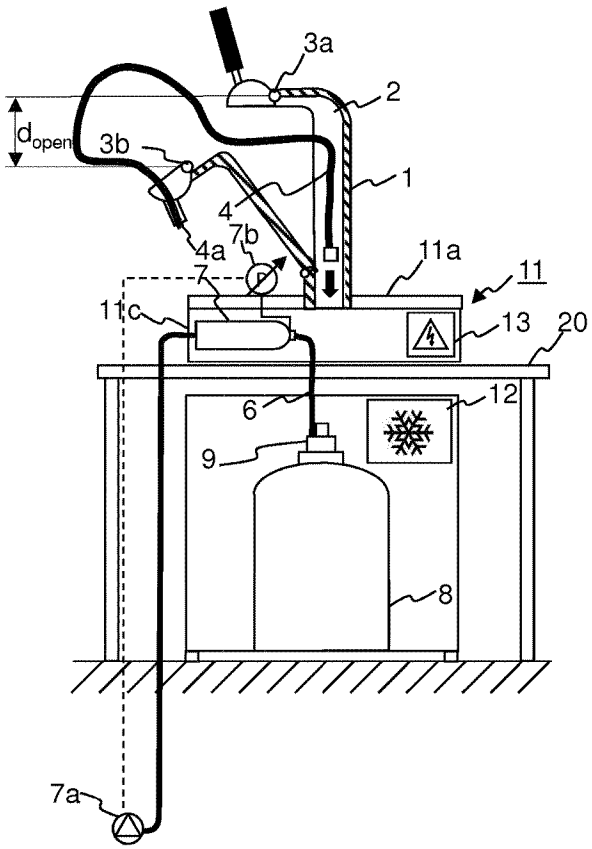
Figure 3C:
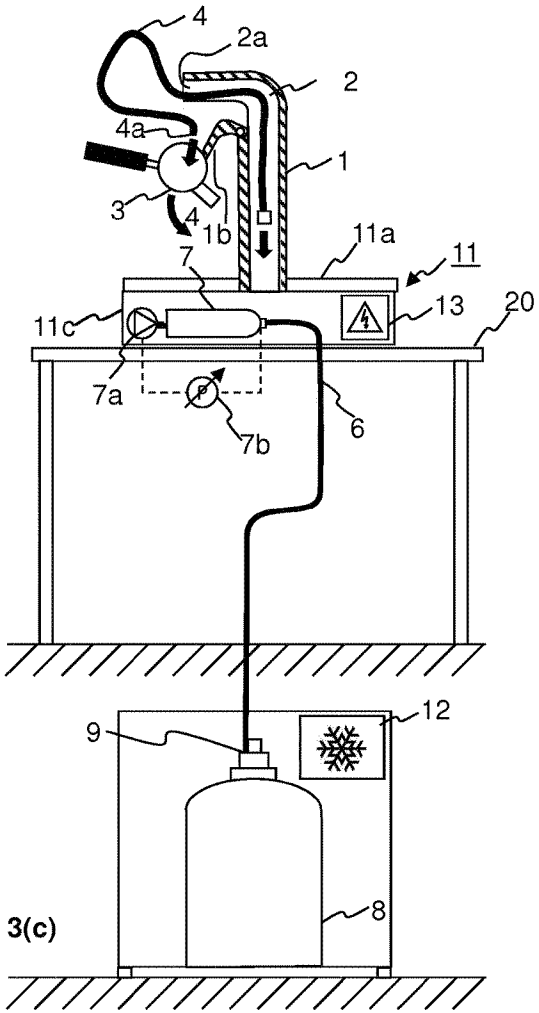

As illustrated in FIGS. 1 and 2, the present invention concerns a compact beverage dispensing unit for dispensing a beverage which can be laid on top of a worktop (20) and easily connected to a keg (8) containing a beverage to be dispensed. By its compactness and ease to move, such dispensing unit can be used alike in public houses as well as at temporary events offering the same dispensing conditions as encountered in a public house. Such units are particularly suitable for dispensing beer and beer like beverages (i.e., comprising malt), cider, and any other ready to dispense beverages). The dispensing units of the present invention distinguish themselves from soda dispensers wherein a source of carbonated water is mixed with a concentrated syrupy composition prior to flowing out of a tap. The use of a pump for pumping the beverage out of to the outlet of the dispensing tube, as described e.g., in U.S. Pat. No. 6,832,487, is not envisaged as it makes a noise not to be associated with the serving conditions encountered in a public house, and in particular, driving beer through a pump is not compatible with the foam forming conditions required in a beer or beer like beverage. The dispensing of beverage in dispensing units according to the present invention is driven by the higher pressure reigning in the container compared with the ambient atmosphere. The high pressure in the container is achieved by bringing a source of pressurized gas (7) in fluid communication with the interior of the container (8) by a pressure tube (6). The source of pressurized gas (7) can be a pressurized cartridge, a solid carrier such as a zeolite or carbon black with gas molecules adsorbed on the surface thereof, or a compressor. In the latter case, the beverage never contacts any element of the pump. This is used solely for increasing the pressure inside the container.

When existing roving dispensing units as revised in the Background Art supra are generally provided complete with a cooling compartment or fridge topped by a dispensing column, and requiring wheels for displacing them; the present dispensing unit is much more compact and light and can be transported by hand and would fit in most car boots. Unlike the foregoing dispensing units, the unit of the present invention is not a stand-alone type of dispensing furniture, but should be laid on top of a worktop (20) like a counter, a table or the like, as illustrated in FIG. 2.

As in traditional dispensing units, an elongated, hollow tapping column (1) extends substantially normal to the top surface (11*a*) of a base portion (11). An inlet end of the tapping column is fixed to said top surface (11*a*) and it comprises an elongated inner channel (2) bringing in fluid communication said inlet end of the column with a tapping valve head (3) located at the opposite top, outlet end of the elongated tapping column. The channel (2) and tapping valve head (3) are suitable for receiving and for controlling the flow of liquid through a dispensing line (4) connected to the interior of a beverage container (8) stored elsewhere. The tapping column comprises an elbow for directing the flow of beverage downwards and it should be sufficiently high to allow a standard glass of beer to fit between the tapping valve head (3) and the top surface of said base portion (11).

The base portion (11) to which the tapping column is fixed comprises a support plate comprising a top surface (11*a*) and a bottom surface (11*b*) and an opening connecting said top and bottom surfaces. The channel (2) of the tapping column must be in fluid communication with said opening of the support plate in order to allow passage of a dispensing tube from the valve head (3) to below the support plate (11), whence it can extend to the dispensing outlet of a pressure container (8), typically a keg. A peripheral wall (11*c*) juts out of the bottom surface (11*b*) of the support plate and extends along at least a portion of the perimeter of said support plate, preferably extending over at least 50% of the perimeter of the support plate, and thus defining with said bottom surface (11*b*) an inner volume of the base portion. The free edge of the peripheral wall (11*c*) should be suitable for stably supporting the support plate (11*a*) at a distance from a planar surface said peripheral wall rests upon. Strictly speaking, three feet distributed around the perimeter of the base plate would suffice to stably hold the support plate at a distance from the surface they rest upon. For aesthetic reasons, however, it is preferred that a peripheral wall hides the inner volume thus defined from outside observers, as a number of items can be lodged in said inner volume, including dispensing and pressure tubes. The distance between the support plate and worktop surface (20) the dispensing unit is laid upon corresponds to the height of the peripheral wall (11*c*) or, if it applies to the at least three feet described above. The height of the peripheral wall should be such that the beverage dispensing unit be suitable for dispensing beverages when standing on the top surface of a counter or a worktop (20) as found in traditional pubs and restaurants. Since such worktops and counters generally have a height comprised between 80 and 130 cm, the peripheral wall (11*c*) should have a height comprised between 50 and 300 mm, preferably between 70 and 200 mm, more preferably between 100 and 150 mm to afford comfort of use. A thin base portion is preferred for higher counters, and also for ease of transport and handling. On the other hand, a higher height allows the accommodation of more features within the inner volume of the base portion.

In particular, the dispensing unit also comprises a source of pressurized gas (7) lodged in the inner volume of the base portion. It also comprises connecting means (6) suitable for connecting said source of pressurized gas to the interior of a beverage container (8) located outside the inner volume of the base portion. The source of pressurized gas (7) can be a pressure cartridge filled with pressurized gas. Because of the reduced space available within the inner volume of the base portion, the dimensions of the cartridge are restricted to the detriment of the use range of such cartridge. A solution for storing more gas in a reduced volume at a reduced pressure is to adsorb gas onto a solid surface, such as a zeolite, carbon black, etc. But here too, a limited use time is afforded by such solution. A gas compressor, preferably an air compressor can be lodged in the inner volume of the base portion. It has the advantage of not having a limited service time, but it has the inconvenience of the noise produced when raising the pressure inside the container (8).

An alternative solution is to provide a pressure cartridge filled with pressurized gas or a solid substrate with gas molecules adsorbed on the surface thereof as source of pressurized gas (7), and to connect said source to a compressor (7*a*) suitable for refilling with gas the source of pressurized gas, when the pressure becomes insufficient. The source (7) therefore acts as a pressure buffer between the compressor (7*a*) and the container (8). As illustrated in FIGS. 1(*b*)&(*c*) and 3(*c*)&(*d*), a pressure gauge (7*b*) can be mounted on the source of pressurized gas to measure the pressure therein. A CPU can activate the compressor (7*a*) as soon as the pressure inside the source of pressurized gas falls below a given threshold value of , e.g., 1.1 bar, preferably 1.05 bar. As shown in FIG. 1(*b*), the compressor (7*a*) can be lodged within the inner volume of the base portion (11). This has the advantage of having a compact dispensing unit with a long lasting source of pressurized gas (7) integrated therein. The noise remains a drawback, but the compressor would run only when the pressure inside the source (7) falls below the threshold value and not every time beverage is being dispensed. This also increases the service life of the pump which is switched on and off considerably less often with Furthermore, the base portion (11) can be sound insulated e.g., with a foam lining the walls thereof. Alternatively, in case the user has a compressor available in house, the compressor (7*a*) can be located outside the base compartment (11) as illustrated in FIGS. 1(*c*) and 3(*d*). This embodiment reduces the cost of the dispensing unit and can solve the noise problem of the compressor. For example, many public houses store compressors and kegs in the cellar or in a closed side room remote from the counter and dispensing columns. As shown in FIG. 3(*c*), a line (4) may run from the dispensing unit to a keg stored in the cellar or in a side room. Similarly and as shown in FIG. 3(*d*) a line can run from the source of pressurized gas (7) to such compressor (7*a*) in the cellar or a side room. One such compressor (7*a*) can be used to refill the sources of pressurized gas of several dispensing units, since it needs to run only when the gas pressure in a source (7) drops below a given value. In this case, it can be advantageous to connect the compressor to a manifold whence pressure lines run to the sources of pressurized gas (7) of several dispensing units. Said pressure lines can be provided with valves controlled by a CPU to ensure that gas compressed by the compressor (7*a*) is routed towards the under-pressurized sources (7) only.

Although a dispensing unit according to the present invention may function without any external power, it may be advantageous to lodge in the inner volume of the base portion (11) a source of power (13), such as a battery, or an AC/DC transformer (13) with connecting means to the AC supply net. These can be used to run a compressor (7, 7*a*) if any is used or for illuminating decorative lights disposed on the tapping column or base portion, such as a display panel mounted on the tapping column and indicating the type of beer dispensed by such column, and the like.

It is highly advantageous for the user if the dispensing unit comprises means for determining the volume of liquid dispensed in a time range or still contained in the container. Since in pressure controlled dispensing units, the liquid does not flow through a pump, the number of pump strokes cannot be used as an indicator of the volume of liquid dispensed in a given time range. The volume of liquid dispensed is approximately proportional to the pressure ($>P_{atm}$) inside the container and to the time the valve is maintained open. This approximation can be taken advantage of only if the pressure inside the container can be controlled with accuracy. Using a compressor (7*a*) coupled to a source (7) of pressurized gas (7) acting like a pressure buffer as discussed supra with reference to FIGS. 1(*b*)&(*c*) and 3(*c*)&(*d*) has the advantage of requiring only a small container (7) which can fit in the inner volume of the base portion of the dispensing unit, whilst ensuring a substantially constant pressure inside the container throughout the dispensing lifetime of the container (e.g., using a pressure control valve). This way a simple CPU can be integrated in the system, measuring the dispensing time of the valve, and calculating accordingly the amount of liquid dispensed in a given time (e.g., daily). This information is useful for management of the stocks and also to profit of times of low activity for changing a container which is nearly empty. The same could be used with a pressure cartridge filled with pressurized gas of high capacity, but then it would not fit in the inner volume of the base portion. A pump directly connected to the container would not allow an accurate enough control of the pressure inside the container to yield meaningful approximation of the dispensed volume of liquid, with pressure peaks every time the pump is actuated.

Figure 4B:
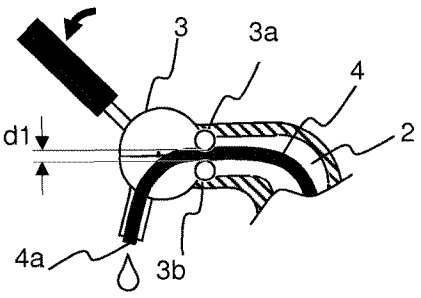
FIG. 4: shows an example of pinch valve (a) in a closed position with first and second jaws at a distance, d0, from one another and (b) in an open position with first and second jaws at a distance, d1, from one another.
Figure 4A:
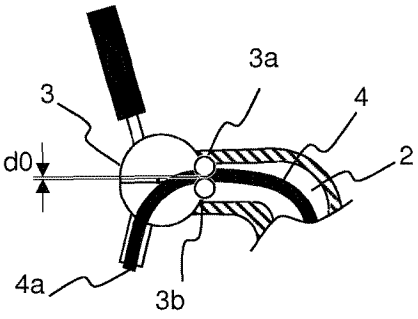
Figure 3B:
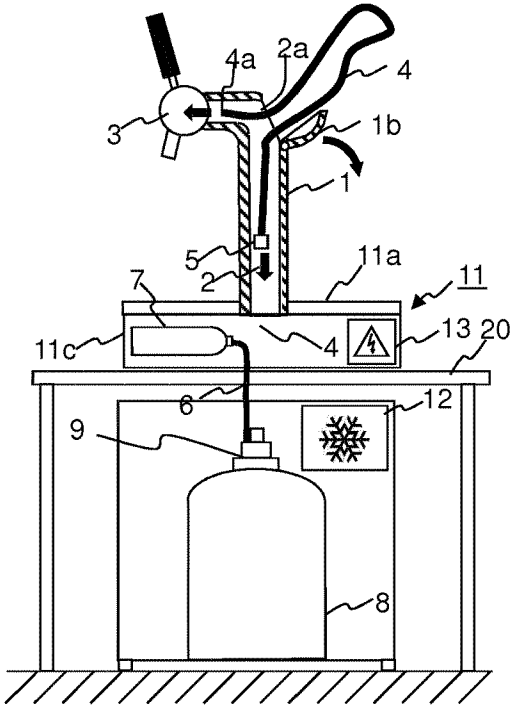
FIG. 3: shows four embodiments of dispensing assemblies allowing a dispensing tube to be introduced in a top-down fashion.
Figure 3A:
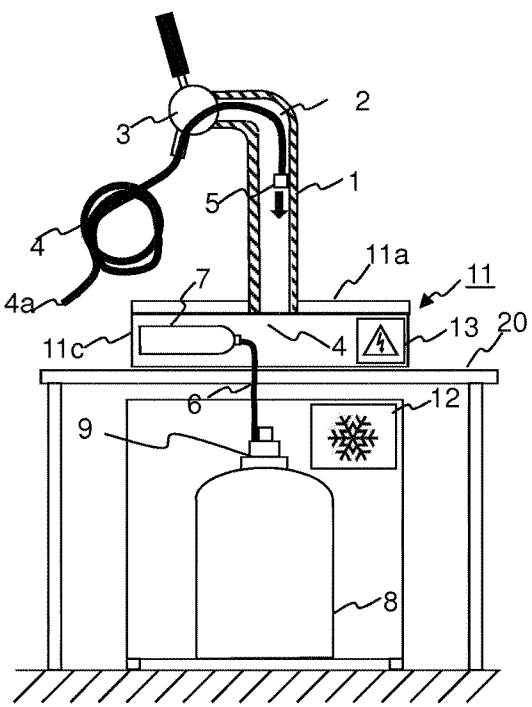

It is a mandatory requirement, for hygienic reasons, that all the parts of the unit being in contact with the liquid to be dispensed be disposable and changed with each new container connected to the unit. This requirement applies in particular to the tapping valve. The use of a pinch valve (3*a*, 3*b*) positioned in the valve head (3) at the top end of the tapping column is particularly preferred because it is a cheap, hygienic and reliable valve system, requiring only that the outlet portion (4*a*) of the dispensing line be flexible to collaborate with the pinch valve. As illustrated in FIG. 4, a pinch-valve comprises first and second jaws (3*a*, 3*b*) suitable for receiving in pinching relationship the flexible portion of the outlet end (4*a*) of said dispensing line. The flow of liquid is controlled by varying the distance between the first and second jaws (3*a*, 3*b*) from a first, closed position, d0, (cf. FIG. 4(*a*)), wherein the flexible portion of the dispensing line is squeezed and no liquid can flow therethrough to a second, open position, d1, (cf. FIG. 4(*b*)), wherein the dispensing line is not squeezed completely and liquid can flow through the line, Pinch valves are advantageous in that the liquid never contacts the jaws of the pinch valve which therefore needs not be changed with each new keg, and the outlet portion (4*a*) of the dispensing line is a simple, flexible tubular portion simply engaged between the jaws of the pinch valve. Pinch valves are therefore a very economical and reliable option.

In an alternative embodiment (not illustrated), the tapping valve is composed of a first valve element mounted in the valve head (3) at the top end of the tapping column and of a second, valve co-element mounted at the outlet portion (4*a*) of the dispensing line, and required to be coupled with the first valve element to bring the tapping valve in tapping configuration. This embodiment is more expensive than a pinch valve discussed above, since the dispensing line must be provided with a second valve co-element, but it may be advantageous, for example, in providing a fool proof safety feature, preventing any liquid from flowing out of the container until the dispensing line (4) is fully connected to a closed tapping valve. With a pinch valve, the user must first open the jaws of the pinch valve to insert the dispensing tube, and must necessarily close the valve (i.e., pinch the flexible portion of the dispensing line), before connecting the inlet end to the container. If the pinch valve is not closed upon connecting the line to the container, liquid may accidentally flow out. This problem could be avoided with a valve co-element mounted at the outlet portion of the dispensing line.

The first inlet end of the dispensing tube is provided with connecting means (5) suitable for connecting said inlet end to the container thus bringing the liquid contained in the container in fluid communication with the outlet end of the dispensing line. In a preferred embodiment, the connecting means (5) provide a releasable coupling to the container, such as by means of a bayonet, a threaded nut, a pin, preferably with a safety feature like a ring provided at one end thereof, and the like. In an alternative embodiment, the coupling obtained with the connecting means (5) to the container is permanent, such as with a resilient snap-fit. This solution offers the same advantage as the dispensing tube permanently connected to a container disclosed in US 2004/0226967, in that when a keg is empty it cannot be removed without removing at the same time the dispensing line (4), so that a new dispensing line (4) must necessarily be mounted with the next keg, which ensures the hygienic conditions of the unit. By contrast with a dispensing tube permanently attached to the keg, the present invention using a snap-fit connecting means allows a "top-down" insertion of the dispensing tube.

In a preferred embodiment of the present invention, a new dispensing tube (4) can be introduced from the top of the tapping column (1) through the inner channel (2) all the way down through the base portion (11) whence it can extend and be coupled to a keg by means of a connecting means (5). This "top-down" insertion mode of the dispensing tube is substantially more comfortable than the traditional "bottom-up" insertion mode used in all the roving dispensing units disclosed to date. In case the container (8) is stored in a cellar as illustrated in FIG. 3(*c*), the bottom-up sequence would be most inconvenient, if not, non-enabling. In a top-down insertion mode as proposed in the present invention, the inlet end of the dispensing tube, including the connecting means (5) can be introduced from the outlet of the channel (2) of the tapping tower (1) as illustrated in FIG. 3(*a*), engaged into the valve head (3) with the pinch valve jaws (3*a*, 3*b*) held in open position, with a distance between jaws of at least, d1, or more as illustrated in FIG. 4(*b*), and driven all the way down the inner channel to the inner volume of the base portion (11) and then further to the keg, where it can then be connected to the container (8).

In an alternative embodiment illustrated in FIG. 3(*b*)-3(*d*), the channel (2) comprises an opening (2*a*) located upstream from the pinch-valve, whence the inlet end of the dispensing line, including the connecting means (5), can be driven through the channel (2) down into the inner volume of the base portion (11). The outlet end of the dispensing tube can be introduced into the valve element from upstream, wherein upstream and downstream refer herein to the dispensing direction of flow of the beverage. In case a pinch valve (3*a*, 3*b*) is used, a safety feature can prevent the opening (2*a*) of the tapping tower to be closed unless the pinch valve (3) is closed, in order to ensure that the tapping valve (3) is closed prior to coupling the connecting means (5) of the dispensing tube to the container. In FIG. 3(*b*), the channel opening (2*a*) is located at the elbow of the the tapping column and is closed by a moving lid (1*b*). In another embodiment illustrated in FIG. 3(*c*)&(*d*), a whole section of the tower can be opened, as described, e.g., in EP 1982952. As illustrated in FIG. 3(*d*), to further facilitate engagement of a new dispensing tube (4) between the jaws (3*a*, 3*b*) of a pinch valve, the means for opening a portion of the channel (2) may include the pinch valve (3*a*, 3*b*) such that, upon opening the moving lid (1*b*) the first and second jaws (3*a*, 3*b*) can be separated from one another by a distance, $d_{open}$, substantially larger than the one corresponding to the open, dispensing position, d1. In the embodiments illustrated in FIG. 3(*c*)&(*d*) it is preferred that the portion of the channel (2) which can be opened comprises at least 60% of the total length of the channel, preferably at least 80%, more preferably at least 90%. This facilitates the engagement of a new dispensing tube into the channel.

In yet a preferred embodiment, the tapping valve head (3) comprises a hinge assembly allowing the first and second jaws (3*a*, 3*b*) to be separated by a distance larger than the one corresponding to the open position, d1. Such hinged tapping valve head (3) could either be separable from the column (1) or, alternatively, it could remain attached to the body of the column, and the opening of a moving lid (1*b*) would trigger the opening of the valve head (3) about its hinges.

The use of a compact dispensing unit according to the present invention is very simple. As it comprises all the functions of traditional tapping columns, it can be used as a permanent tapping column, not meant to be moved, with the advantage of a much lower price than a permanent tapping column. Alternatively, it can be moved from one place to another depending on the needs thereof. The dispensing unit must be laid onto a worktop (20) such as a counter typical in public houses, or even on a table. A container (8) containing a beverage can be stored in an adequate place. Preferably, the container (8) is stored in a cooled compartment (12). The container (and cooled compartment) can conveniently be positioned under or adjacent the worktop (20) on which the unit is laid, as in FIG. 2. Alternatively, as illustrated in FIG. 3(*c*) the container can be stored in a cellar or side room. A new dispensing line (4) must be engaged into the valve head (3), loaded in the channel (2) of the tapping tower (1) and passed into the inner volume of base portion (11) whence it can be run and coupled to the container. Similarly, the pressure line (6) which is coupled to the pressurized gas (7) must be run and coupled to the container (8). If the source of pressurized gas (7) is to be coupled to a compressor (7*a*) exterior to the dispensing unit, as illustrated in FIGS. 1(*c*) and 3(*d*) then the two components should be connected and the dispensing unit is ready for use. Openings must be provided to allow the passage of the various dispensing and pressure lines (4, 6) on the worktop on which the unit is laid, in the cooled compartment in which the container (8) is stored, and if it applies, in the floor or a wall, if the container (8) or compressor (7*a*) is located in a cellar or a side room.

The compact dispensing unit of the present invention is the most versatile ever put on the market. As it is cheap, and its installation is so easy, it conveniently replaces tapping towers permanently fixed to a counter, and it also advantageously replaces the stand alone, roving dispensing units available to date, which are rather bulky and difficult to transport in view of the size of the cooling compartment integrated in the unit.

The invention claimed is:

1. A beverage dispensing unit comprising:

(A) A base portion, comprising:

(i) a support plate comprising a top surface and a bottom surface and an opening connecting said top and bottom surfaces, (ii) a peripheral wall jutting out of the bottom surface of the support plate and extending along at least a portion of the perimeter of said support plate, and stably supporting the support plate at a distance from a planar surface said peripheral wall rests upon, said distance corresponding to the height of the peripheral wall, wherein the peripheral wall, bottom surface and planar surface define an inner volume of the base portion;

(iii) a source of pressurized gas lodged in the inner volume of the base portion, and a connecting device fluidly connecting said source of pressurized gas to the interior of a beverage container located outside the inner volume of the base portion; and (B) an elongated tapping column extending substantially normal to the top surface of the base portion, an inlet end thereof being fixed to said top surface and comprising an elongated inner channel bringing in fluid communication via said opening, the inner volume of the base portion with a tapping valve head located at the opposite top, outlet end of the elongated tapping column, said channel and tapping valve head being dimensioned for receiving a dispensing line inserted into said tapping valve head and into the interior of said beverage container through said channel and for controlling the flow of liquid through said dispensing line, wherein the peripheral wall has a height comprised between 70 and 200 mm, wherein the source of pressurized gas is a pressure cartridge filled with pressurized gas or a solid substrate with gas molecules adsorbed on the surface thereof, and wherein said source of pressurized gas is connected to a gas compressor located either within or outside of the inner volume of the base portion for refilling the source of pressurized gas when the pressure of the compressed gas stored therein becomes insufficient and, to this effect, said source of pressurized gas is provided with a pressure gauge for measuring the pressure of the gas stored therein and with a CPU for activating the gas compressor as soon as the pressure indicated by the pressure gauge falls below a given threshold value;

a CPU programmed for calculating the volume of liquid dispensed in a given time by computing at least the pressure inside the container and the opening time of the valve, wherein the pressure inside the container is substantially constant during the dispensing lifetime of the container;

lodged in the inner volume of the base portion, a source of power or an AC/DC transformer with a connecting device to the AC supply net, wherein the tapping valve head is openable from a closed configuration to an open configuration, and the tapping column is dimensioned to allow the inlet end of a dispensing tube including the connecting device to be introduced from the tapping column top end and through the tapping valve head held in open position, all the way down to the inner volume of the base portion, wherein the valve element is a pinch-valve comprising first and second jaws for receiving in pinching relationship a flexible portion of the outlet end of a dispensing line and for controlling the flow of liquid therethrough by varying the distance between the first and second jaws from a first, closed position, d0, wherein the flexible portion of the dispensing line is squeezed and no liquid can flow, to a second, open position, d1, wherein the dispensing line is not squeezed or not squeezed completely and liquid can flow through the line, wherein the column comprises an openable portion of channel provided with a device for opening said openable portion of channel including the pinch valve from a closed configuration to an open configuration wherein the first and second jaws are separated from one another by a distance substantially larger than the one corresponding to the open position, d1, wherein the openable portion of the channel comprises at least 60% of the total length of the channel, wherein the tapping valve head comprises a hinge assembly allowing the first and second jaws to be separated by a distance larger than the one corresponding to the open position.

2. The beverage dispensing unit according to claim 1, wherein the source of pressurized gas is a gas compressor, a pressure cartridge filled with pressurized gas, a solid substrate with gas molecules adsorbed on the surface thereof, or any combination thereof.

3. The beverage dispensing unit according to claim 2, wherein the source of pressurized gas is a pressure cartridge filled with pressurized gas or a solid substrate with gas molecules adsorbed on the surface thereof, and wherein said source of pressurized gas is connected to a gas compressor located either within or outside of the inner volume of the base portion for refilling the source of pressurized gas when the pressure of the compressed gas stored therein becomes insufficient and said source of pressurized gas is provided with a pressure gauge for measuring the pressure of the gas stored therein and with a CPU for activating the gas compressor as soon as the pressure indicated by the pressure gauge falls below a given threshold value.

4. The beverage dispensing unit according to claim 2, comprising a CPU programmed for calculating the volume of liquid dispensed in a given time by computing at least the pressure inside the container and the opening time of the valve, wherein the pressure inside the container is substantially constant during the dispensing lifetime of the container.

5. The beverage dispensing unit according to claim 1, further comprising lodged in the inner volume of the base portion a source of power or an AC/DC transformer with a connecting device to the AC supply net.

6. A beverage dispensing assembly comprising:

(A) a beverage dispensing unit, comprising a base portion, the base portion comprising:

(i) a support plate comprising a top surface and a bottom surface and an opening connecting said top and bottom surfaces, (ii) a peripheral wall jutting out of the bottom surface of the support plate and extending along at least a portion of the perimeter of said support plate, and stably supporting the support plate at a distance from a planar surface said peripheral wall rests upon, said distance corresponding to the height of the peripheral wall, wherein the peripheral wall, bottom surface, and planar surface define an inner volume of the base portion;

(iii) a source of pressurized gas lodged in the inner volume of the base portion, and a connecting device fluidly connecting said source of pressurized gas to the interior of a beverage container located outside the inner volume of the base portion; and an elongated tapping column extending substantially normal to the top surface of the base portion, an inlet end thereof being fixed to said top surface and comprising an elongated inner channel bringing in fluid communication via said opening, the inner volume of the base portion with a tapping valve head located at the opposite top, outlet end of the elongated tapping column, said channel and tapping valve head being dimensioned for receiving a dispensing line inserted into said tapping valve head and into the interior of said beverage container through said channel and for controlling the flow of liquid through said dispensing line, wherein the peripheral wall has a height comprised between 70 and 200 mm, standing on the top surface of a counter or worktop of the type found in traditional pubs and restaurants;

(B) a beverage container containing a beverage to be dispensed, and being separate from the beverage dispensing unit, (C) a first dispensing line extending from an inlet end connected to the container and in fluid communication with the beverage contained therein, through the channel of the tapping column, to an outlet end engaged in the valve head, and (D) a second pressure line extending from an inlet end connected to the source of pressurized gas to an outlet end connected to the beverage container, in fluid communication with the interior thereof; wherein the valve head comprises a first jaw and a second jaw such that the first jaw and the second jaw can pinch closed the fluid communication between the inlet end and the outlet end of the first dispensing line, and the first jaw and the second jaw selectively expand a distance apart at least equal to 60% of the total length of the elongated tapping column.

7. The beverage dispensing assembly according to claim 6, wherein the beverage container is placed in a cooled compartment comprising openings for the passage of the dispensing line and pressure line from the inside to the outside, said cooling compartment is located under or adjacent the counter or worktop supporting the dispensing unit.

8. The beverage dispensing assembly according to claim 7, wherein the valve element is a pinch valve and a portion of the outlet end of the dispensing line is flexible.

9. The beverage dispensing assembly according to claim 7, wherein the outlet end of the dispensing line comprises a valve co-element for collaborating with the valve element to control the flow of liquid through the dispensing line.

10. The beverage dispensing assembly according to claim 9, wherein the beverage to be dispensed and contained in the container is beer, carbonated malt based beverages, including non alcoholic beer, or cider.

* * * * *